US007448892B2

(12) United States Patent
Dowdle et al.

(10) Patent No.: US 7,448,892 B2
(45) Date of Patent: Nov. 11, 2008

(54) FLUORESCENT LAMP HOLDER WITH INTEGRAL LOCKING MECHANISM

(75) Inventors: Todd Dowdle, Deep Gap, NC (US); Scott Mast, Mountain City, TN (US)

(73) Assignee: Leviton Manufacturing Corporation, Little Neck, NY (US)

( * ) Notice: Subject to any disclaimer, the term of this patent is extended or adjusted under 35 U.S.C. 154(b) by 0 days.

(21) Appl. No.: 11/314,896

(22) Filed: Dec. 20, 2005

(65) Prior Publication Data

US 2007/0015391 A1 Jan. 18, 2007

Related U.S. Application Data

(60) Provisional application No. 60/637,954, filed on Dec. 20, 2004.

(51) Int. Cl.
*H01R 33/02* (2006.01)
*H01R 33/08* (2006.01)

(52) U.S. Cl. ..... 439/232; 439/362; 439/699.2

(58) Field of Classification Search ..... 439/227, 439/232, 233, 234, 238, 240, 242, 356, 360, 439/362, 364, 699.2
See application file for complete search history.

(56) References Cited

U.S. PATENT DOCUMENTS 3,524,053 A 8/1970 Johnson
3,568,132 A 3/1971 Johnson
3,568,133 A 3/1971 Johnson
3,639,887 A 2/1972 Johnson et al.
3,755,773 A 8/1973 Johnson
3,828,299 A 8/1974 Johnson et al.
4,306,758 A * 12/1981 Johnson et al. ..... 439/232
4,637,671 A 1/1987 Johnson et al.
4,661,885 A 4/1987 Brenner et al.
4,664,465 A 5/1987 Johnson et al.
D294,914 S 3/1988 Brenner et al.
D297,322 S 8/1988 Johnson et al.
D297,529 S 9/1988 Johnson et al.
4,799,896 A * 1/1989 Gaynor et al. ..... 439/232
5,145,392 A * 9/1992 Kemp ..... 439/232
5,688,139 A * 11/1997 Gust et al. ..... 439/239
5,788,525 A 8/1998 Balaban et al.
6,012,938 A 1/2000 Balaban et al.
6,332,796 B1 * 12/2001 Chen ..... 439/226

(Continued)

*Primary Examiner*—James Harvey
(74) *Attorney, Agent, or Firm*—Weiss & Arons, LLP

(57) ABSTRACT

This invention is directed to a lamp holder for receiving the contact pins at the end of a fluorescent lamp. More specifically, for a ceiling mounted fixture, the lamp holders for the contact pins of a fluorescent lamp each include two downwardly extending straight elongated slots or channels spaced to receive the contact pins of the lamp. Mounting of the lamp is accomplished by inserting each pin of the lamp into its own downwardly extending slot in the lamp holder and then pushing the pins up into the slots until they reach the end where they are automatically locked to the lamp holders. The lamp in not twisted or rotated to lock it to the lamp holder. As the contact pins of the lamp are inserted into the channels of the lamp holder, they are captured by a latching member which automatically locks the pins to the receptacle. Removal of the lamp from the lamp holders is accomplished by pulling the lamp straight out of the straight elongated parallel slots after pressing on a part of the latching member to release the pins.

9 Claims, 3 Drawing Sheets

U.S. PATENT DOCUMENTS 6,733,316 B1 * 5/2004 Chen ..... 439/232
6,890,199 B2 * 5/2005 Vogt et al. ..... 439/238
2007/0015391 A1 * 1/2007 Dowdle et al. ..... 439/236

* cited by examiner

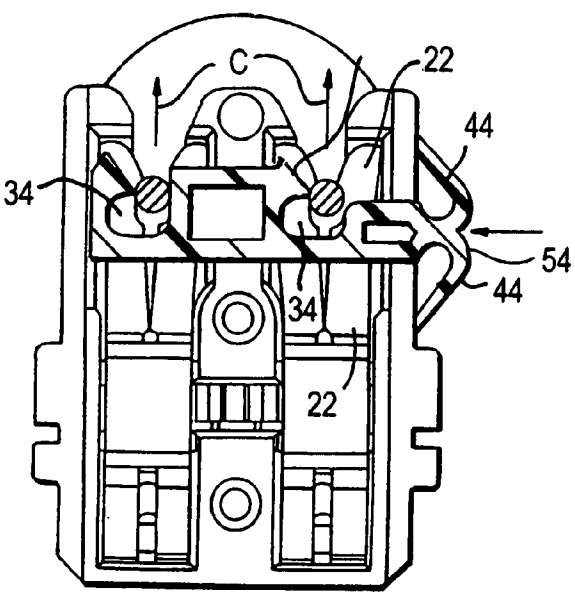
FIG. 2D
FIG. 2E
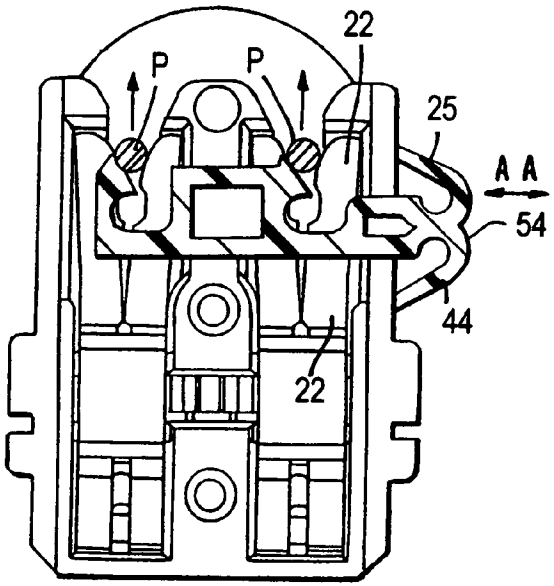
FIG. 2F

FLUORESCENT LAMP HOLDER WITH INTEGRAL LOCKING MECHANISM

This application claims the benefit of the filing date of a provisional application having Ser. No. 60/637,954 which was filed on Dec. 20, 2004.

BACKGROUND OF THE INVENTION

1. Field of Invention

The present invention relates generally to lamp holders and more specifically to lamp holders for a fluorescent lamp.

2. Description of the Prior Art

Fixtures for fluorescent lamps normally comprise an elongate frame having an integral reflector and two lamp holders, one at each end of the elongated frame, for receiving contact pins located at the ends of a fluorescent lamp. The lamp holders, in addition to providing electrical power to the contact pins at the ends of the florescent lamp, also provides support for the lamp.

To connect a fluorescent lamp to the two lamp holders, the two contact pins at each end of the fluorescent lamp are inserted into a lamp holder.

Inserting the fluorescent lamp into the lamp holders requires the user to first align the two contact pins at each end of the fluorescent lamp to a vertical plane, and then insert the pins of the fluorescent lamp into the single vertical slot in each lamp holder. Each of the two contact pins at each end must be inserted completely into the single slot in the lamp holder and, while still holding the fluorescent lamp, rotate the lamp in either a clockwise or counter-clockwise direction, through approximately 90 degrees to both lock the florescent lamp to the lamp holders and electrically connect the pins at the ends of the lamp to the contacts in the lamp holders. This may be difficult, particularly when the lamp holders are located at a height which requires the use to stand on a ladder.

In addition, if an unduly high torque is applied to a misaligned glass tube, it is possible to break the tube with possible injury to the installer. Clearly, a new improved lamp holder which allows a user to more easily insert a fluorescent lamp into lamp holders is needed.

SUMMARY OF THE INVENTION

This invention is directed to a lamp holder for receiving the contact pins at the end of a fluorescent lamp. More specifically, for a ceiling mounted fixture, the lamp holders for the contact pins of a fluorescent lamp each include two downwardly extending straight elongated slots or channels spaced to receive the contact pins of the lamp. Mounting of the lamp is accomplished by inserting each pin of the lamp into its own downwardly extending slot in the lamp holder and then pushing the pins up into the slots until they reach the end where they are automatically locked to the lamp holders. The lamp in not twisted or rotated to lock it to the lamp holder. As the contact pins of the lamp are inserted into the channels of the lamp holder, they are captured by a latching member which automatically locks the pins to the receptacle.

Removal of the lamp from the lamp holders is accomplished by pulling the lamp straight out of the straight elongated parallel slots after pressing on a part of the latching member to release the pins.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIGS. 2A through 2F are vertical sectional views illustrating the position of the parts of the lamp holder as the contact pins of a fluorescent lamp are inserted into and removed from the lamp holder.

DESCRIPTION OF THE PREFERRED EMBODIMENT

Figure 1:
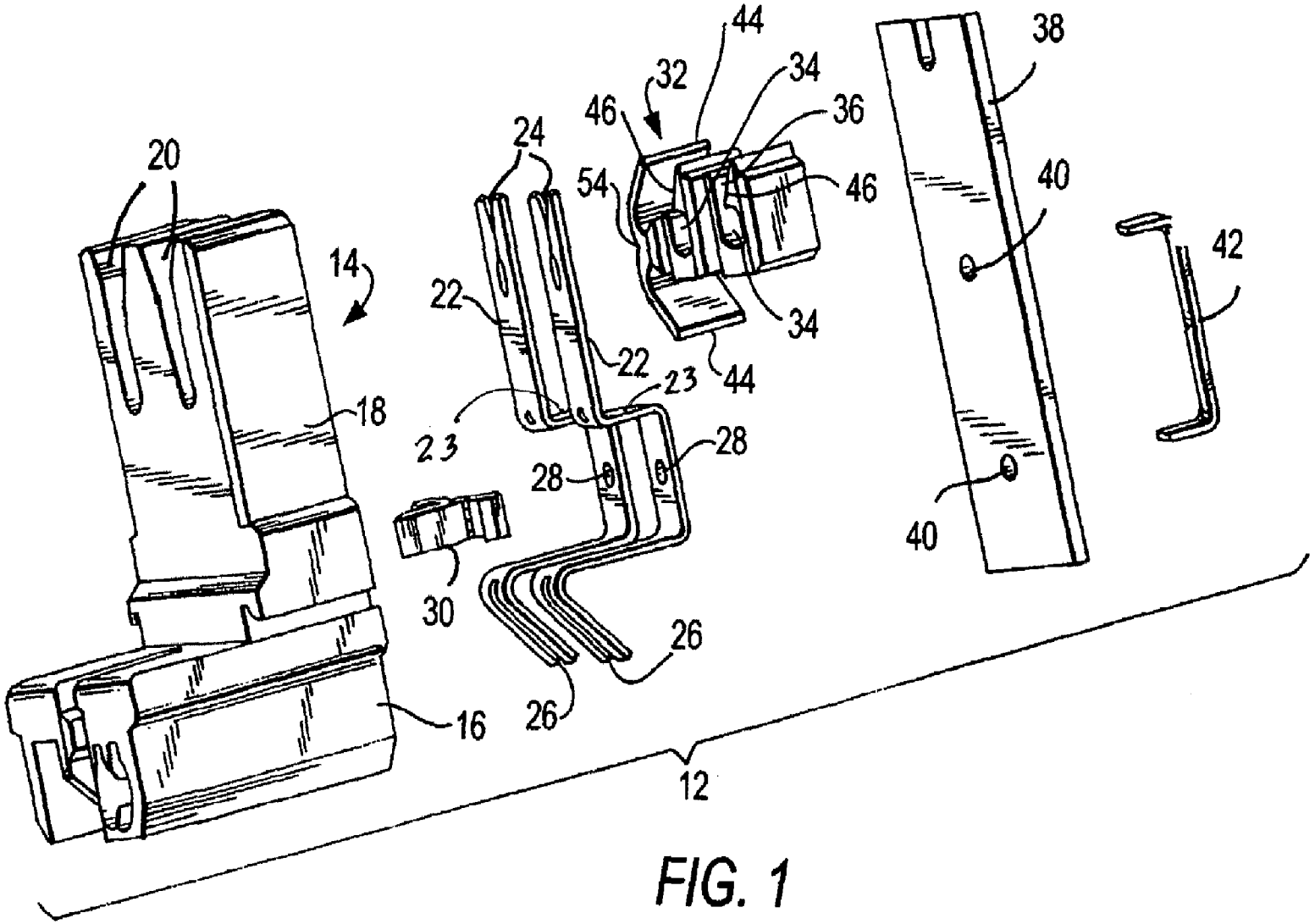
FIG. 1 is an exploded perspective view of a lamp holder for a fluorescent lamp.

Referring to FIG. 1, the lamp holder 12 is comprised of a housing 14 composed of an insulating material such as a plastic having a base member 16 and a leg member 18. The base member is configured to be attached to a fixture for a fluorescent lamp by means of screws or the like, and supports openings for receiving conductors which connect the electrical contacts in the lamp holder to a source of electricity. The leg member 18 supports two straight parallel elongated slots 20 adapted to receive the contact pins of a fluorescent lamp. Located within the leg member and behind the two elongated slots 20 are contact members 22 located to engage the pins of a fluorescent lamp. The contact members are made of a conductive material such as brass and each contact member supports, at one end, an hour glass shaped slot 24 for receiving a lamp contact pin. A bifurcated contact 26 at the other end of the contact member is provided for receiving a wire conductor normally connected to a source of electricity. Each contact member 22 has a shape substantially similar to that shown in FIG. 1 and supports an opening 28 for receiving a rivet, screw or plastic protrusion which extends from the leg member for connecting the contact member to the leg member. A separator member 30 locate between the two contact members 22 is provided to help separate the two contact members from each other and is composed of an insulating material. A latching member 32, the configuration of which is also shown in FIGS. 2A-2F, is located behind contact members 22 and supports two finger shaped spring members 44 which project through a side wall of leg member 18. Latching member 32 supports two chambers 34 which are aligned with the bottom of the hour glass shaped slots 24. Each chamber is tangentially connected to a passageway 36 located to allow the contact pins of a fluorescent lamp to enter the chambers 34. Located behind the leg member 18 is an insulating fiber cover 38 having two openings 40 for receiving the ends of a staple 42 which is used to lock the fiber cover to the back of the leg member by engaging a part of the leg member such as a rib part.

Operation of the lamp holder is more fully explained by referring to FIGS. 2A through 2F. Leg member 14 includes two straight parallel positioned elongated slots 20, 20 which extend into the leg member 18 and are adapted to receive the contact pins of a fluorescent lamp. Located within the leg members are contact members 22, 22, each of which supports an hour glass shape slot 24 aligned with a slot 20 in the leg member. The bottom of each hour glass shape slot can be substantially circular and slightly smaller than the diameter of the contact pin of the lamp. In operation, as the contact pin of the lamp is pushed down in the hour glass shape slot 24, the legs on each side of the slot are forced apart to allow the contact pin to move down past the narrow central portion and enter the opening in the substantially circular opening at the bottom of the slot. The opening at the bottom of the slot is slightly smaller than the diameter of the contact pin and, therefore, squeezes the contact pin to make good electrical contact with the contact pin. The hour glass shape of the slot also helps hold the contact pin in the substantially circular opening at the bottom of the slot 24.

Shoulders 23 of contact members 22 may be inserted into recess 21 in the back of leg member 18. Shoulders 23 may thus contact shelf 25 in the back of leg member 18. Shelf 25 may help prevent contacts 22 from moving vertically when the contact pins are inserted in slots 24.

Figures 2A, 2B, 2C:
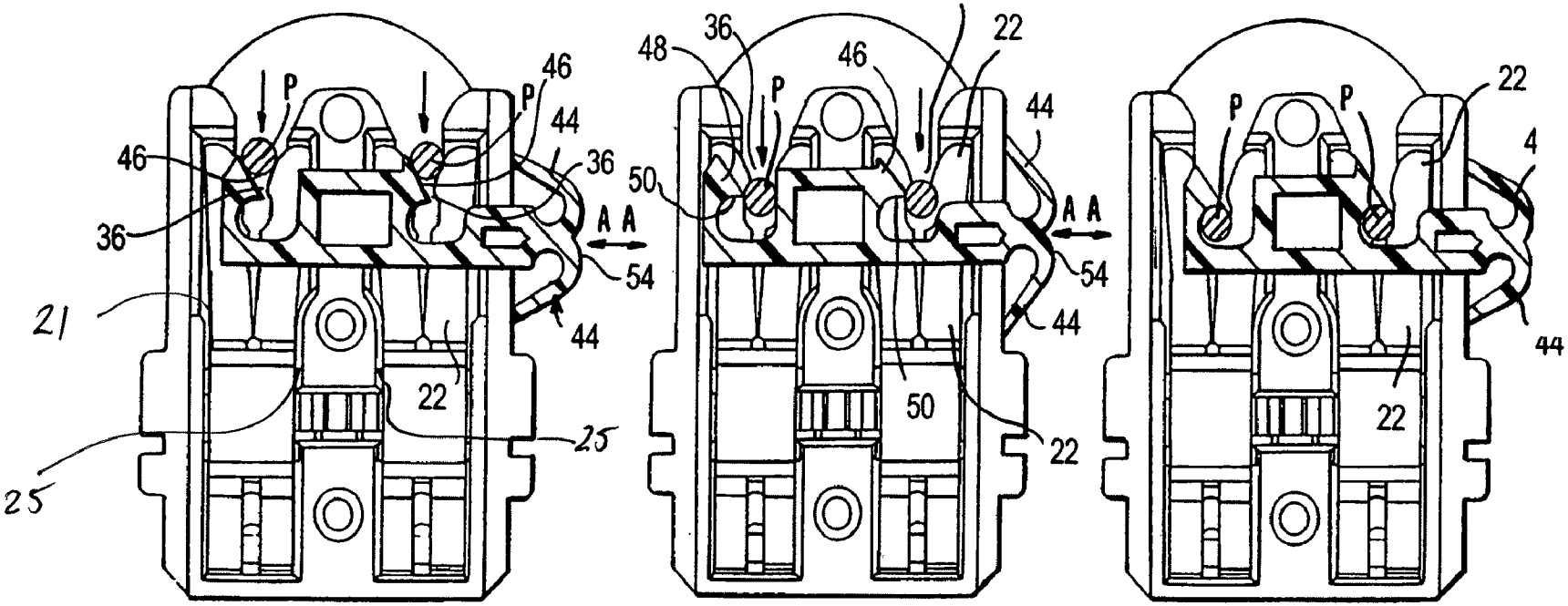

Located within leg member 14 is latching member 32. Referring to FIGS. 1, 2B and 2C, the latching member, which can be composed of a resilient non-conductive material such as nylon or the like, can slide back and forth in the direction A-A, see FIGS. 2A-2C, as the contact pins of a lamp are being inserted into the slots in the lamp holder. The latching member includes a pair of finger shaped springs 44 which bear against an outside surface of leg housing which urges latching member 32 to the position shown in FIGS. 2A and 2C. The latching member includes a pair of cam surfaces 46, 48 located in passageways 36 which are aligned with the parallel slots 20 in the leg housing and the hour glass shape slots in the contact members 22 when the latching member is in its "at-home" position. Located to the left of where passageways 36 enters chambers 34 is a locking shoulder 50 in each chamber which locks the contact pins of a lamp in the bottom of the slots 20.

The lamp holder described above is for an electric discharge lamp such as a fluorescent lamp where the latching member functions as an internal locking mechanism to secure a fluorescent lamp in the lamp holder after the lamp has been properly inserted. The latching member operates independently of the hour glass shape slots in the current carrying contact members 22, to provide added lamp seating security during handling and operation of a lamp fixture when connected to a fluorescent lamp. With this invention, the lamp is never rotated to lock it to the lamp holder during lamp insertion.

Referring to FIGS. 2A through 2F, there is shown the operation of the latching member during insertion and removal of a lamp from the lamp holder. FIG. 2A shows the contact pins p-p of a fluorescent lamp being placed into the elongated slots 20 of the leg member 14. Continued downward movement of the contact pins p-p causes the hour glass shape slots 24 in the contact members 22 to spread apart and the pins of the lamp engage the cam surfaces 46 of the latching member 32 to urge the latching member to slide toward the left as shown in FIG. 2B. Thus, as the contact pins are moved down, they urge the latching member 32 to move to the left against the biasing effect of the spring members 44.

Looking at FIG. 2C, the pins p-p of the lamp have advanced to a position that is passed the cam surfaces 46 and have entered chambers 34 whereupon the spring members 44 urge the latching member 32 to move to the right to cause the locking shoulders 50 of the chambers to be positioned over the contact pins and lock them in position in the slots 20 of the lamp holder. At this time, the pins are securely locked in the bottom opening of the hour glass shape slots 24 of the contact members 22 and are electrically connected to the contact members 22.

A user can remove the lamp from the lamp holder by pressing on the end 54 of the latching member, against the force of the shaped springs 44, to move the latching member toward the left as shown in FIG. 2D. As the latching member moves to the left, the locking shoulders 50, 52 are moved away from the contact pins, see FIG. 2E, and the lamp contact pins p-p can be removed from the chambers 34 in the latching member and the hour glass shape slots in the contact members by pulling the lamp out of the elongated slots in the lamp holder. After the contact pins of the lamp are removed from the lamp holder and the user releases his/her finger pressure on the end of the latching member 54 as shown in FIG. 2F, the latching member is urged to its at-home position by the finger shaped springs 44.

As is apparent from the preceding description, the fluorescent lamp is mounted to the lamp holder by advancing the contact pins of the lamp down through channels 20 in the lamp holder which automatically moves the latching member 32 laterally to allow the contact pins of the lamp to enter the chambers 34. Removal of the contact pins and, therefore, the lamp from the lamp holder is effected by pressing the end 54 of the latching member to cause the latching member 32 to move to the left and allow the pins to be pulled up through passageways 36 in the latching member 32. As the pins are pulled upwardly, they move out of the hour glass shape slots in the contact members 22 and the elongated slots 20 in the lamp holder. At no time during removal of the lamp from the lamp holder is the lamp twisted or rotated.

While there have been shown and described and pointed out the fundamental novel features of the invention as applied to the preferred embodiment, it will be understood that various omissions and substitutions and changes of the form and details of the method and apparatus illustrated and in the operation may be done by those skilled in the art, without departing from the spirit of the invention.

What is claimed is:

1. A lamp holder for a fluorescent lamp comprising:

two straight parallel slots, elongated in a first direction, for receiving the contact pins at an end of the lamp;

contacts, fixed in said first direction with respect to the slots, for engaging the contact pins at an end of the slots; and a latch for holding the contact pins, the latch biased toward a first closed position by a resilient member, the latch being movable against said bias relative to the contacts to a second position by application of force from the contact pins inserted into the slots.

2. A lamp holder having first and second straight parallel slots for receiving contact pins at one end of a fluorescent lamp comprising:

first and second contact members in a fixed alignment with respect to a first direction along said first and second slots in said lamp holder for engaging and making electrical contact with the lamp contact pins placed in said slots;

a latching member located in said lamp holder having a first at home position and a second position relative to the contacts; and a spring member coupled to said latching member for urging said latching member to its first position wherein said fluorescent lamp contact pins urge said latching member from said first position to said second position as said contact pins are being moved into position in said lamp holder slots.

3. The lamp holder of claim 2 wherein said latching member comprises a chamber for receiving said fluorescent lamp contact pins.

4. The lamp holder of claim 2 wherein said contact pins engage a cam surface coupled to said latching member to urge said latching member to said second position as said contact pins are being moved in said lamp holder slots.

5. The lamp holder of claim 2 wherein said first and second contact members each has an hour glass shaped slot for receiving lamp contact pins placed in said slots.

6. The lamp holder of claim 2 wherein said latching member has a chamber for receiving said contact pin being moved into position in said lamp holder slot.

7. The lamp holder of claim 2 wherein said latching member has a chamber for each contact pin tangentially coupled to a passageway to allow the contact pins to enter said chamber when said latching member is in its second position.

8. The lamp holder of claim 7 wherein said chambers support locking shoulders which engage said contact pins to prevent them from moving out of said slots while said latching member is in its first position.

9. The lamp holder of claim 8 further comprising a spring member coupled to urge said latching member to said first position.

* * * * *